US005083323A

United States Patent [19]

Cannan

[11] Patent Number: 5,083,323

[45] Date of Patent: Jan. 28, 1992

[54] TOILET CONTROL DEVICE

[76] Inventor: Robert M. Cannan, 1434 Dexter St., Broomfield, Colo. 80020

[21] Appl. No.: 461,995

[22] Filed: Jan. 8, 1990

[51] Int. Cl.[5] ..... E03D 1/00

[52] U.S. Cl. ..... 4/415; 4/324; 4/661

[58] Field of Search ..... 4/415, 427, 661, 381, 4/324

[56] References Cited

U.S. PATENT DOCUMENTS

| | | | |
|---|---|---|---|
| 3,945,057 | 3/1976 | Thenkelsen | 4/324 |
| 4,296,505 | 10/1981 | Chian-Shang | 4/324 |
| 4,351,071 | 9/1982 | Clar | 4/415 X |
| 4,391,003 | 7/1983 | Talerico et al. | 4/381 X |
| 4,700,413 | 10/1987 | Lopez | 4/415 X |
| 4,837,867 | 6/1989 | Miller | 4/415 X |

*Primary Examiner*—Henry K. Artis
*Attorney, Agent, or Firm*—Harold A. Burdick

[57] ABSTRACT

A retrofitable or original equipped device for tank type toilets having a pull strap 40 which is held in place by a beam section 10 in a fixed position by a lock and release 12 that will allow a toilet operator to quickly and easily interrupt the flushing process of the toilet to prevent an overflow, to ease cleaning or to prevent a young child from drowning. In addition, a device that can be easily installed without tools and will remain in a ready to use state without interfering with normal toilet operations.

6 Claims, 3 Drawing Sheets

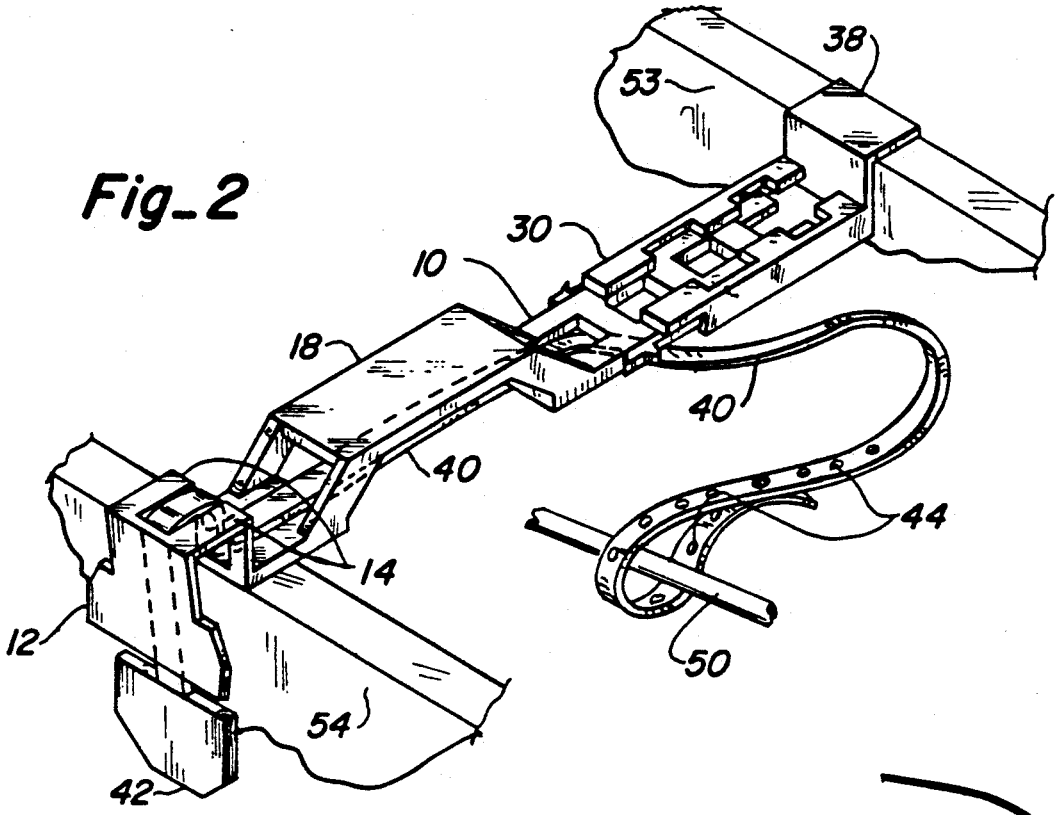
Fig_2
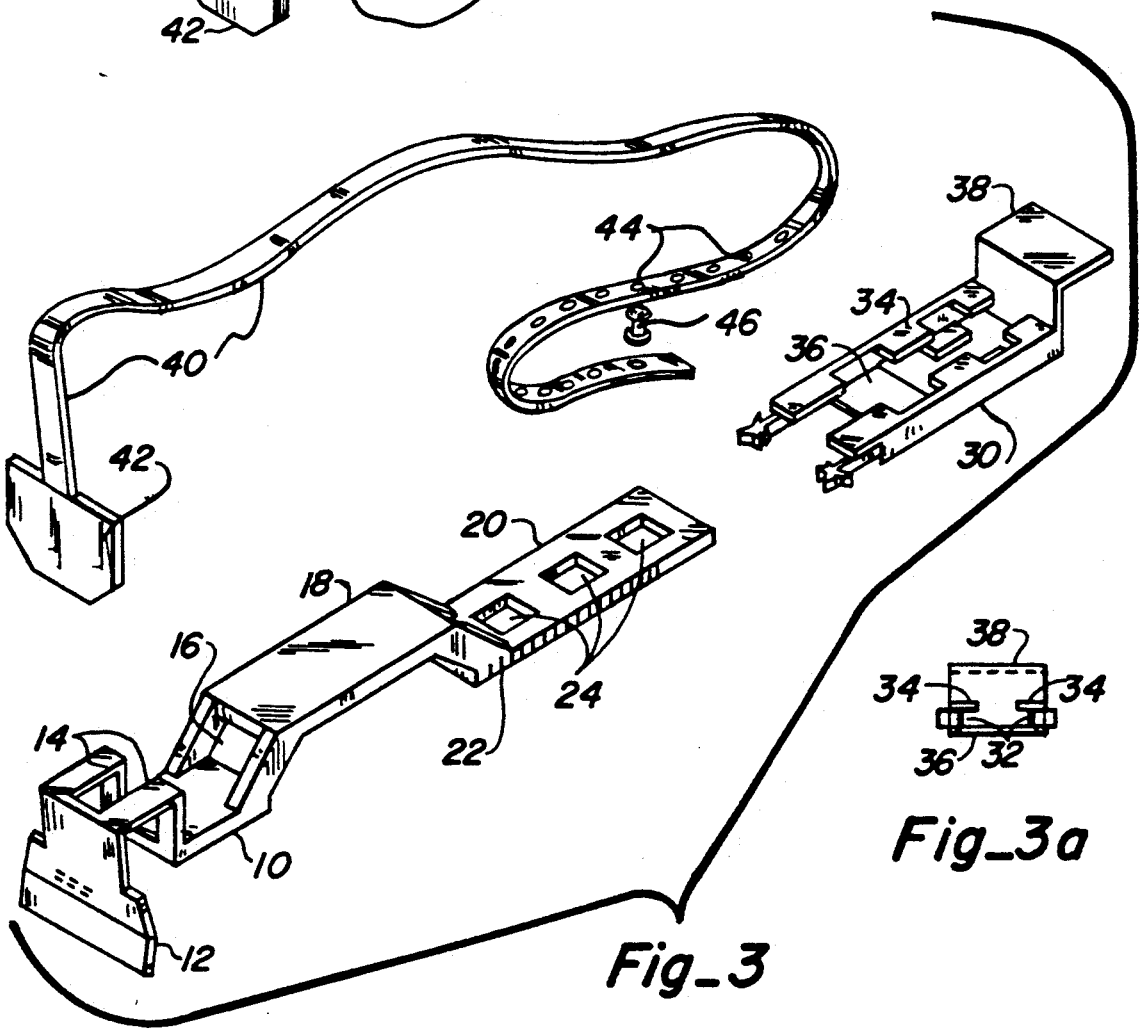
Fig_3
Fig_3a

TOILET CONTROL DEVICE

FIELD OF INVENTION

This invention relates to toilet valving mechanisms. Specifically to tank type toilets with valving mechanisms that employ an active float to control a volume of water within a holding tank which is retained until it is used in the flushing process.

BACKGROUND OF THE INVENTION

Manufacturers of tank type toilets and replacement parts for those toilets, have in the past, employed a wide variety of techniques and common mechanisms to control the flushing and refill process.

In the flushing and refill process, a manually-operated lever on the toilet holding tank opens a flapper valve in the bottom of the tank. This releases the water from the tank into the toilet bowl, displacing the contents of the bowl through an air lock (a "P" trap) and into the sewer system. After the tank has emptied from the flush, the flapper valve automatically closes, allowing a fresh supply of water to be retained by the tank. Common toilet designs use a float to control the fresh water supply valve. This assembly is located inside the tank. Upon flushing, the float lowers with the water level to a down position causing the water supply valve to open, filling the empty toilet tank and bowl simultaneously. In typical toilet designs approximately 20 percent of the fresh water from the water supply valve is delivered through a tube into the toilet bowl. The remaining 80 percent is discharged directly into the tank. As the tank fills, the float rises with the water to a preset level to an up position causing the water supply valve to close. This stops the filling of both the tank and the bowl.

An examination of prior art involving mechanisms designed to supplement or enhance the operation of common toilets, shows that the primary efforts of these inventions have been directed toward controlling the volume of water within the toilet tank for the purpose of saving water. They do not teach a means for an operator of a toilet to interrupt the flushing and refilling process.

Toilets and toilet control mechanisms suffer from one primary disadvantage: their control is extremely limited. Once the flapper valve has opened and the flushing process has begun, it cannot be easily or quickly interrupted.

The only way to interrupt the flushing and refilling process is to shut off the fresh water supply. Current toilet designs allow two methods of doing this:

METHOD I: The operator can reach down to the exterior water supply valve (not previously mentioned), usually located outside and below the toilet tank. This valve is often referred to as a water stop. It is typically very difficult to reach and is usually either seized (stuck open) or cannot be closed without extraordinary effort. On many toilets the water stop is not installed. This, of course eliminates this method.

METHOD II: The operator can gain access to the water valve and float assembly. The tank lid must be cleared of debris and removed. Then the operator must reach inside the tank, grab the float arm, and manually pull it up to close the water valve. Unfortunately this is a slow and cumbersome process. In addition, when using this method, in order for the valve in the tank to remain closed, the operator must continue to hold the float. Upon letting go, the valve reopens and refilling resumes.

The two methods described, shutting off the water stop and accessing the automatic refill mechanism, are only available if the operator is aware of them. Often it is the case that individuals do not possess this knowledge. Heretofore, neither the toilet manufacturers nor the product distributors have made efforts to make this information known. Nor is there evidence that altered toilet designs are forthcoming that will correct these disadvantages.

SUMMARY OF THE INVENTION

This invention provides a toilet refill control device for toilets having a tank and a water supply valve for predetermining the volume of water admitted to the toilet in a refilling process of a flushing cycle, the device being selectively utilized for temporary interruption of the refilling process. The device includes an appendage having a gripping aperture connected with the toilet's water supply valve, and actuating means connected with the appendage and positioned exteriorly of the tank for manual actuation of refilling process interruption.

The device preferably includes an irregular beam assembly mountable at the tank for holding the appendage in position in the toilet, the irregular beam assembly including adjustable mounting sections. The appendage is preferably a flexible appendage, and the device preferably includes a lock and release for releasably holding the flexible appendage at a selected fixed location.

Accordingly a number of objects and advantages of my invention are:

A. To provide a control device, or device for toilets that will allow an operator of a toilet to quickly and easily interrupt the refilling process of a toilet to prevent an overflow in the event of a sewer stop up.

B. To provide a control device that will save water that is lost from a toilet overflow.

C. To provide a control device for toilets that will allow an operator of a toilet to easily interrupt the refilling process of a toilet to empty (or to nearly empty) the bowl and the tank for cleaning purposes.

D. To provide a control device that will save water by reducing the need for repeat brushing and flushing techniques often used in cleaning a full toilet bowl and tank.

E. To provide a control device for toilets that will allow an operator of a toilet to easily interrupt the refilling process of a toilet to empty (or nearly empty) the bowl to prevent small children from accidental drowning.

F. To provide a control device for toilets that will easily fit current varying toilet tank dimensions and valving mechanisms.

G. To provide a control device for toilets that can be easily installed without tools.

H. To provide a control device for toilets that will remain in a ready to use state without interfering with normal toilet operations.

F. To establish a need by operators of toilets to control the flushing and refilling process for consideration in future toilet designs.

BRIEF DESCRIPTION OF DRAWING FIGURES

In the drawings closely related figures have the same numbers but different alphabetic suffixes.

FIG. 2 shows a close up view of how the toilet control switch will appear after it is installed on the toilet tank.

FIG. 3 shows an exploded view of the switch and the three main components: the beam section, the telescoping section and the pull strap.

FIG. 3*a* is an end view of a telescoping end of the device.

Figure 4:
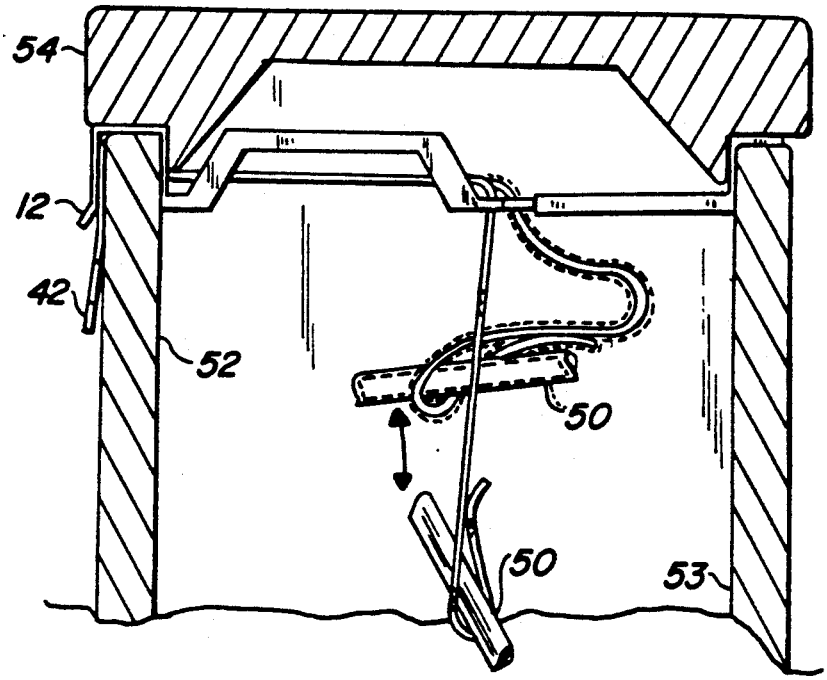

FIG. 4 shows the switch installed on a toilet tank and various aspects of the toilet when the switch is in a non-use mode.

Figure 5A:
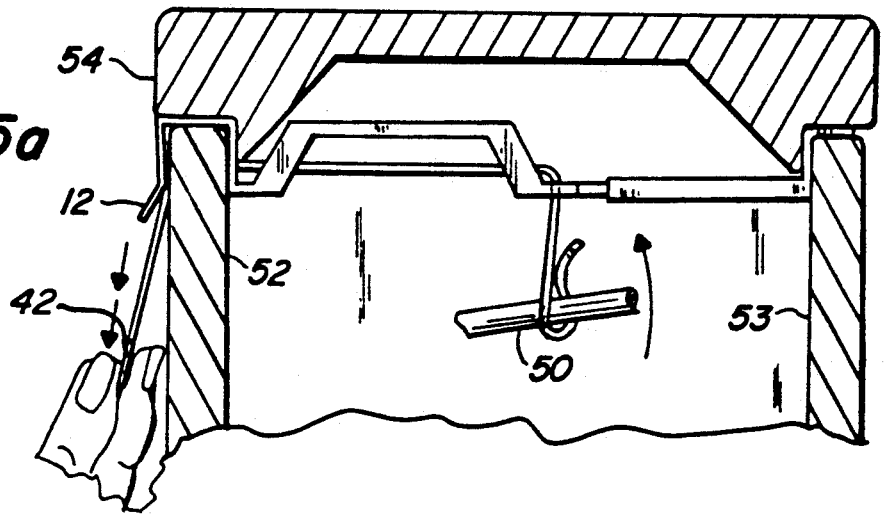
Figure 5B:
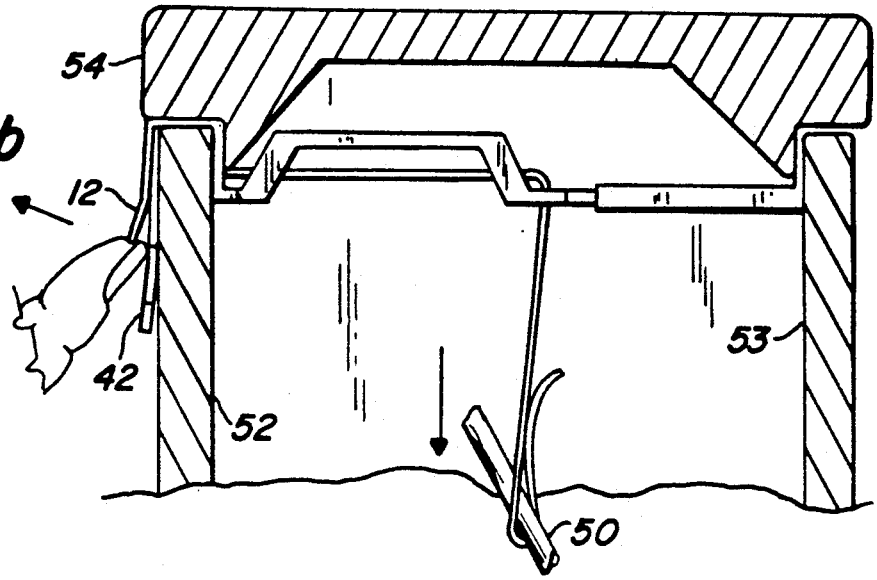

FIGS. 5*a* and 5*b* show the switch installed on a toilet tank and various aspects of its operation.

REFERENCED NUMERALS IN DRAWINGS

10—Beam Section
12—Lock and Release
14—Beam End Rest
16—Strap Tunnel
18—Flush Lever Clearance Arch
20—Extension End
22—Serrations
24—Down Holes
30—Telescoping Section
32—Telescoping Section Locks
34—Extension End Holding Fingers
36—Lower Cross Brace
38—Back End Rest
40—Pull Strap
42—Pull Tab
44—Strap Perforations
46—Loop Button
48—Shim Material
50—Water Valve Float Arm
51—Water Valve
52—Forward Toilet Tank Wall
53—Back Toilet Tank Wall
54—Toilet Tank Lid
55—Flush Lever
56—Flapper Valve

DESCRIPTION OF THE INVENTION

Figure 1:
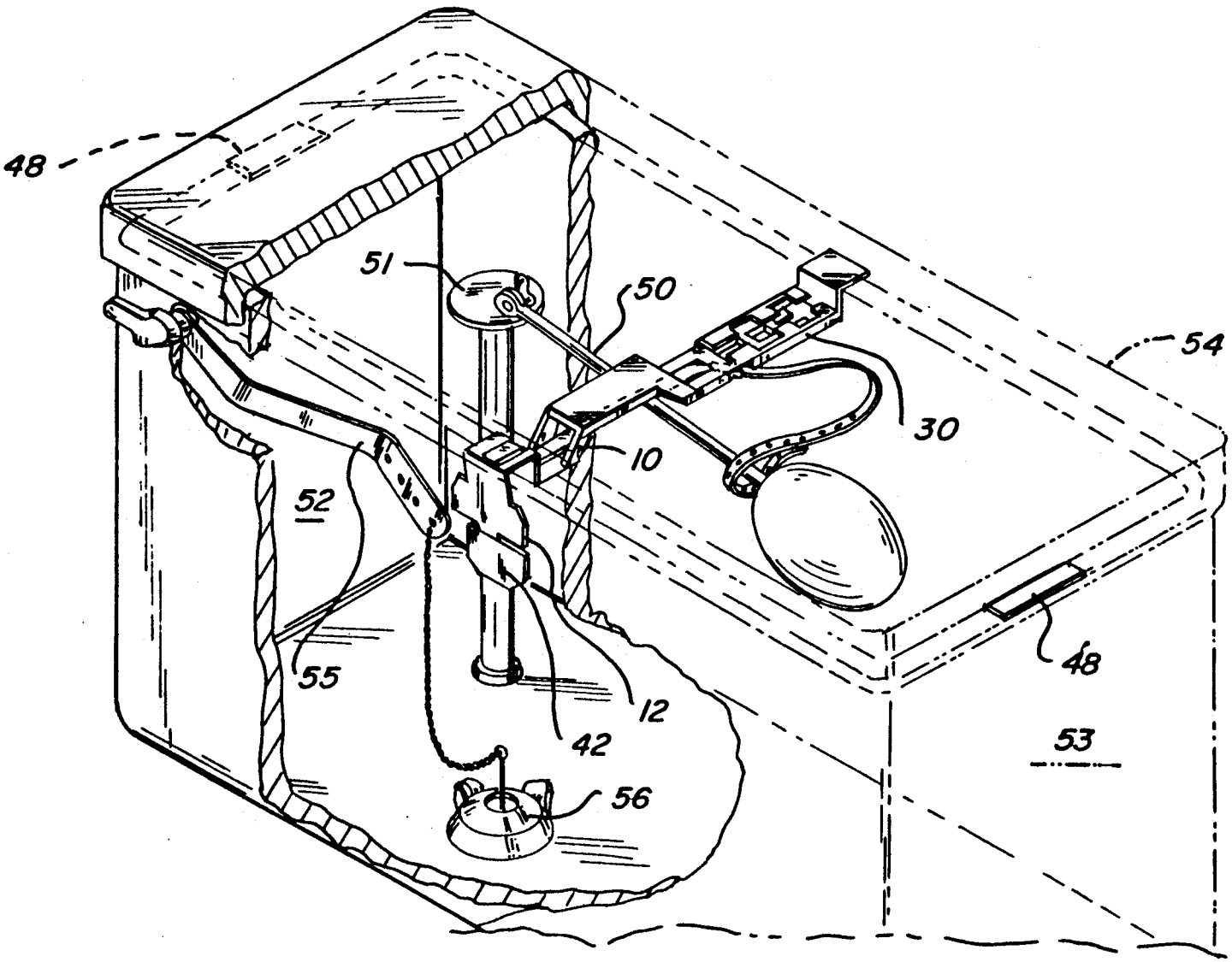
FIG. 1 shows how the toilet control device, or switch, will appear after it is installed on the toilet tank.

FIGS. 1 and 2 show an isometric projection of a basic version of the control device of my invention as it appears on a toilet tank after installation. Made of non-corrosive materials, the toilet switch assembly has three primary components: the beam section 10, the telescoping end 30, and the pull strap 40.

As shown in FIGS. 1 and 2, the toilet switch assembly is installed inside and on top of a toilet tank. It resides across the short span of a typically rectangular-shaped toilet tank and is situated approximately above the fresh water valve float arm 50. The beam and telescoping sections form a ridged, adjustable, irregular beam assembly that remains stationary after it is installed. The primary working component is the pull strap.

The pull strap is a flexible appendage made from a material such as polyethylene, polypropylene, vinyl, nylon, rubber, various plasticized impregnated or laminated fibrous materials, etc. The pull strap has on a single end, numerous perforations 44 which allow the strap to be attached to the valve float arm 50. From the float arm the strap is routed up and through the beam section 10 and is revealed below a lock and release 12 on the exterior of the toilet tank. After the switch is installed, the toilet tank lid 54 is refitted to its normal position on top of the tank. In effect, the lid sandwiches the beam end rest 14 and the back end rest 38. Lid rocking is prevented by installing shim material 48 (FIG. 1) on the tops of the tank walls opposite the toilet switch.

FIG. 3 illustrates the various details of the beam section 10, the telescoping section 30 and the pull strap 40 as they would appear unassembled.

At the forward end of the beam section is the lock and release 12. It is shaped in a downward-flap/hanging-tab configuration, the lower third of which kicks out (off of vertical) approximately 30°. The upper end of the lock and release is attached to the horizontal section of the beam end rest 14. The horizontal section and vertical legs of the rest, in conjunction with the lock and release, form a stable platform on which the beam section 10 is attached. Over all dimensioning of this platform allows the lock and release to flex in a longitudinal direction outward from the tank wall on which it resides.

In addition, a channel is formed through which the pull strap can move. Thickness of material for certain sections in this area are critical. Specifically the inside vertical legs of the beam end rest must be minimized so as not to interfere with the refitting of certain brand name tank lids. Typically a 0.050 inch to 0.090 inch thickness is appropriate. In addition, thickness of the horizontal section of the beam rest must be minimized. This is done to reduce the upward displacement of the tank lid that occurs with the installation of the switch. It should be noted that thinner thicknesses of these areas which result in a weaker part, can be compensated for by increasing the overall width. Design flexibility can also accommodate any required changes in strap dimensions.

Extending inward from the beam end rest is the strap tunnel 16 and the flush lever Clearance arch 18. Overall height of this section should be no greater than the overall height of the end rest 14. Thicknesses can vary widely as long as pull strap clearances and structural rigidity are not compromised. This portion of the beam is arched to allow clearance for the upward swinging motion of the toilet flush lever 55 connected to an external flushing activator e.g., a conventional flushing handle (not numbered, see FIG. 1) when the toilet is flushed. Generally consisting of a flat four legged configuration, numerous sizing possibilities exist that will serve the function.

Extending inward still further is the extension end 20. Dimensioning of its cross section is directly dependent upon certain dimensions of the telescoping section 30. In particular, the height from the extension end holding fingers 34 to the lower cross brace 36 and the inside dimension of the telescoping section locks 32. The extension end must be able to insert itself into the telescoping section without excessive play and still allow the locks to function correctly. Generally flat in shape, the extension end embodies a number of down holes 24. The size of these holes should be minimized to maintain structural ridgity of the extension end while having adequate clearances to allow the pull strap to move freely through them. Hole locations are spaced in an equal manner. Located on each side of the extension end, are serration marks 22 designed and placed to receive the serrated teeth on each of the telescoping section locks 32.

Separate from the beam section 10 is the telescoping section 30. Primarily a flat rectangular tube configuration, it is designed to slide longitudinally onto the extension end 20 while minimizing interference with the down holes. As previously discussed, the inside dimensions of the telescoping section are of critical importance. In particular, the height from the extension end holding fingers 34 to the lower cross brace 36 and the inside dimension of the telescoping section locks 32. Located at the forward end and extending outward form the telescoping section, the locks are finger-like in shape. Each lock has a small number of protruding teeth which face toward the center of the telescoping section. Each set of teeth are located toward the tips of each lock. The locks are flexible to allow the telescoping section to be loaded (slid) onto the extension end. The teeth of the locks will mesh with the serration marks 22 on the extension end restricting the movement of the telescoping section. Situated at the opposite end of the telescoping section is the back end rest 38.

Overall dimensioning considerations for this end are not critical with the notable exception of thickness. As with the beam end rest 14, the thickness is minimized so as not to interfere with the refitting of certain brand name tank lids. Typically 0.090 inch or less.

Separate from the beam assembly and exhibited on FIG. 3, is the pull strap 40. Located on a single end of the strap is a pull tab 42. With the toilet switch installed (while in a non-use mode) the tab is revealed below the lock and release 12 on the exterior of the toilet tank. From this location the tab can be easily grabbed by human fingers to thus actuate interruption of the flush cycle. Attached to the tab and running up and underneath the lock release, is the flexible section of the pull strap. When using the toilet switch, the strap must be able to move freely through the channels and orifices or the beam section 10. On the opposite end from the pull tab (on the pull strap) is an arrangement of perforations 44. Any two of these perforations can be mated together by using a loop button 46 (or any such similar device) to attach the strap to the toilet water valve float arm 50.

From the above description, it is apparent that the design and configuration of the various component parts, lend themselves to inexpensive and available manufacturing techniques.

The numerous materials which can be used in the manufacturing processes to be employed, will help to ensure ease of production, design flexibility and low cost.

The nonrestrictive nature of the various designed configurations embodied by my invention, will allow flexibility of design that will help to ensure ease of production and low cost.

The design and configurations embodied by my invention, will help to ensure its ease of installation on a wide variety of toilet tanks.

FIG. 1 is a good example of the toilet control device as it is fitted to the tank of a toilet in its assembled form.

The switch is installed with the pull strap as it is shown in FIGS. 1 and 2. At the time of installation, the telescoping section 30 is completely retracted against the legs of the flush lever clearance arch 18. In certain instances, this may require the installer to release the telescoping section locks 32 by placing one finger on one lock, another finger on the other lock and squeezing. This action releases the locks and allows the telescoping end to move freely in any direction. After it is in its retracted position, the assembly is placed near its final location. The beam end rest 14 is then lowered onto and on top of the forward tank wall 52. After the forward rest is in position, the telescoping end is extended outward toward the back toilet tank wall 53 until the back end rest 38 can be situated on the top of the wall.

After the beam assembly has been fitted to the tank, an appropriate down hole 24 must be selected for the pull strap. The strap is routed through the hole to be attached to the water valve float arm 50.

FIGS. 4 and 5 show plane views of the switch in place and the working principles of the invention.

With the assembly in place, as in FIG. 4, the strap can be attached to the float arm 50. This must be done with the pull strap in a position that puts the pull tab 42 just under the lock and release 12 and with the float arm in the down position. With the strap attached, installation is completed.

FIG. 5*a* shows how to interrupt the flushing process. The operator simply grabs the pull tab 42 and pulls it downward. This causes the float arm 50 to go to the up position, shutting off the Water valve 51 that fills the toilet.

FIG. 5*b* shows how to disengage the toilet switch to allow normal toilet operations. The operator will place a finger under the lock and release 12 and pull outward. This will allow the pull tab to be retracted as the float arm drops to the tank water level. The toilet will now operate normally.

FIG. 4 shows how the toilet switch will look after installation. It also shows how the switch will be in a continuous "ready to use" mode without interfering with normal toilet operations. When the tank is full, the float arm 50 is in the up position. The pull strap 40 is flexible and does not restrict this movement. Upon flushing, the tank empties and the float arm goes to a down position. Again, the pull strap is flexible and does not restrict this movement.

Accordingly, the reader will see that the device of this invention will provide a convenient method for an operator of a toilet to interrupt (shut down) the flushing process of a toilet if it is required. The device can be manufactured easily and inexpensively and made available to consumers at a low cost.

Furthermore, the device offers additional advantages in that:

- It allows an operator of a toilet to quickly and easily shut down a toilet to prevent an overflow in the event of a sewer stop up.
- It allows an operator of a toilet to quickly and easily shut down a toilet to save water that is lost from a toilet overflow.
- It allows an operator of a toilet to easily shut down a toilet to empty (or nearly empty) the bowl and the tank for cleaning purposes.
- It allows an operator of a toilet to easily shut down a toilet to save water by reducing the need for repeat brushing and flushing techniques often used in cleaning a full toilet bowl and tank.
- It allows an operator of a toilet to easily shut down a toilet to empty (or nearly empty) the bowl to prevent accidental drowning of small children.
- It will easily fit current varying toilet tank dimensions and valving mechanisms.
- It can be easily installed without tools.
- It will remain in a ready to use state without interfering with normal toilet operations.

It will establish a need by users of common toilets to interrupt the flushing process for consideration in future toilet designs.

Although the description above contains numerous specifications, these should not be construed as limiting the scope of the invention but as merely providing illustrations of some of the presently preferred embodiments of the invention. For example, the main beam assembly can have other shapes that will allow the invention to be installed on a non-typical or new design toilet tank. These other shapes can also allow the device to be mounted in a different location on the toilet. This can include means that will allow an operator to easily interrupt the flushing process of toilets, or new design toilets, by locating a refill valve control that is easily accessible to the operator. That the color, material and shape etc. of the exposed parts can vary.

Thus the scope of the invention should be determined by appended claims and their legal equivalents, rather than by the examples given.

I claim:

1. A toilet refill control device for toilets having a tank, an external flushing activator, and a water supply valve for predetermining a volume of water admitted to the toilet in a refilling process of a flushing cycle, the device being selectively utilized for temporary interruption of the refilling process, said device comprising:

an appendage having a gripping aperture connected with the water supply valve; and actuating means connected with said appendage and positioned exteriorly of the tank and spaced from the flushing activator for manual actuation of refilling process interruption.

2. The device of claim 1 further comprising an irregular beam assembly mountable at the tank for holding said appendage in position in said toilet.

3. The device of claim 2 wherein said irregular beam assembly is fitable to said toilet by means of adjustable mounting sections.

4. The device of claim 1 wherein said appendage is flexible, said device further comprising a lock and release, said flexible appendage being held at a selected fixed location by means of said lock and release.

5. The device of claim 4 wherein said lock and release is attached to and held in position by said irregular beam assembly.

6. A toilet refill interrupt device for toilets having a tank, an external flushing activator and a water supply valve for admitting water into the toilet in a refilling process of a flushing cycle, the device comprising:

a flexible appendage having an aperture at one end thereof engagable with the valve;

an assembly for holding and mounting said flexible appendage at said tank;

actuating means connected with said flexible appendage and positionable exteriorly of the tank and spaced from the flushing activation for manual actuation of refilling process interruption; and lock and release means positioned at the tank for selectively engaging said flexible appendage for locking said appendage at, and releasing said appendage from, selected locations.

* * * * *